137-13
7/5/77 XR 4,033,269

United States Patent [19]

Little et al.

[11] 4,033,269

[45] July 5, 1977

[54] METHOD AND APPARATUS FOR CONTROLLING GAS FLOW

[75] Inventors: Alma M. Little, Salt Lake City, Utah; Harry R. Ralston, Silver City, N. Mex.

[73] Assignee: Kennecott Copper Corporation, New York, N.Y.

[22] Filed: Dec. 24, 1975

[21] Appl. No.: 644,149

[52] U.S. Cl. ..... 110/160; 137/13; 137/824

[51] Int. Cl.[2] ..... F23L 11/02

[58] Field of Search ..... 137/13, 823, 824, 803; 23/277 C; 110/147, 160, 161; 431/20; 261/DIG. 9, DIG. 54

[56] References Cited

UNITED STATES PATENTS

| | | | |
|---|---|---|---|
| 3,215,501 | 11/1965 | Phillips | 110/160 X |
| 3,527,177 | 9/1970 | LaRue | 110/160 X |
| 3,566,811 | 3/1971 | Tidd | 110/160 X |
| 3,574,562 | 4/1971 | Kawahata | 23/277 C X |
| 3,951,082 | 4/1976 | Leggett et al. | 23/277 C X |

*Primary Examiner*—William R. Cline
*Attorney, Agent, or Firm*—Mallinckrodt & Mallinckrodt

[57] ABSTRACT

Flow of gas through a conduit of a gas-handling system, particularly the exhaust system of a material processing furnace operating at high temperatures, is controlled by directing a control gas (usually air) into the conduit in opposition to the normal flow of gas therethrough at a location such that it can comprehend substantially the entire cross-sectional area of the conduit substantially without diminution of such area or interference with fluid flow at such location when full normal flow is desired. The apparatus includes a duct leading from a pressure source of control gas to nozzle means disposed substantially entirely outside the conduit but with the discharge therefrom directed into the conduit from at least one side thereof and in opposition to normal gas flow through the conduit.

5 Claims, 3 Drawing Figures

METHOD AND APPARATUS FOR CONTROLLING GAS FLOW

BACKGROUND OF THE INVENTION

1. Field :

The invention is concerned in general with the use of controlled flow of air or other gas in opposition to normal gas flow in a conduit as a control for such normal gas flow.

2. State of the Art:

Mechanical valves or dampers are normally employed to control flow of fluids through conduits. Heretofore, controlling flow of a fluid through a Venturi has been proposed by injecting a control fluid through openings circumferentially of the Venturi section of a flow conduit, but this provides only a minimum range of control without the possibility of complete shut-off. Nozzles positioned coaxially of respective flowing streams of a liquid of a gas have also been proposed for controlling flows of such streams, but these are impractical for many uses.

SUMMARY OF THE INVENTION

In accordance with the present invention, close control of flow of a gas through a conduit at high temperature and over a range of no flow to full flow, is attained by introducing a gas — usually air — into the conduit from at least one side thereof in direction opposed to the normal flow of gas through the conduit and at a flow rate capable of accomplishing the extent of control desired. Introduction of the control gas is substantially without diminution of the cross-sectional area of the conduit and substantially without interference with fluid flow through the conduit when full normal flow is desired.

THE DRAWING

In the accompanying drawings, which illustrates an embodiment presently contemplated as the best mode of carrying out the invention in actual practice:

FIG. 1 represents a fragmentary view in side elevation of, and partly in vertical section taken axially through, an off-gas exhaust system of a metal refining furnace embodying the present invention;

FIG. 2, an enlarged perspective view of the portion of FIG. 1 encircled by the line 2 in FIG. 1; and FIG. 3, a fragmentary vertical section taken on the line 3—3 of FIG. 1 and drawn to the larger scale of FIG. 2.

DETAILED DESCRIPTION OF ILLUSTRATED EMBODIMENTS

Figure 1:
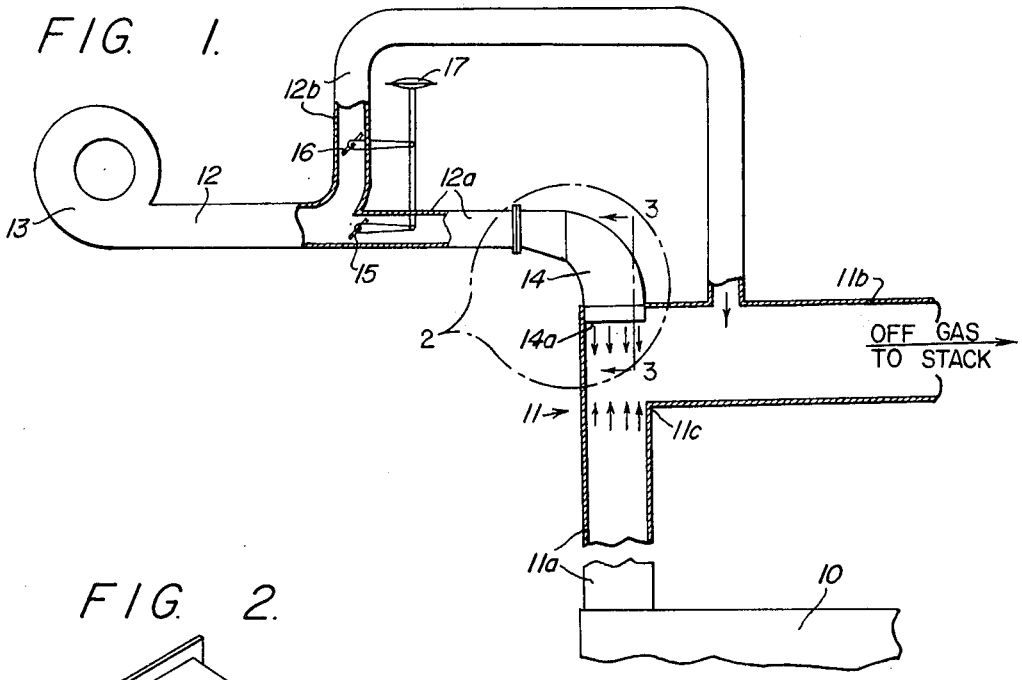
Figure 2:
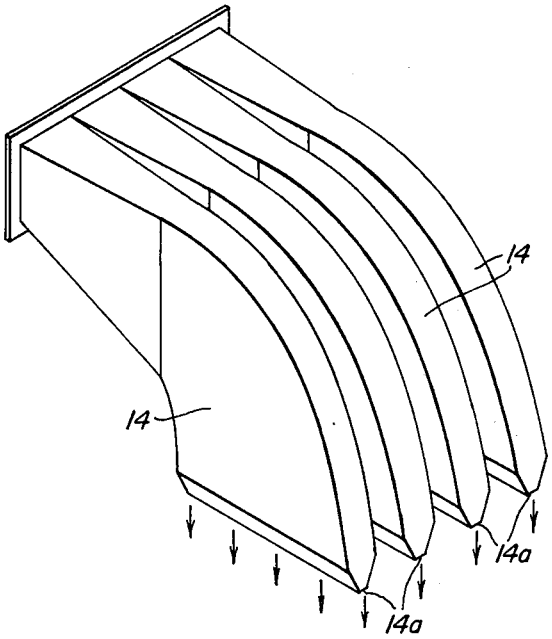
Figure 3:
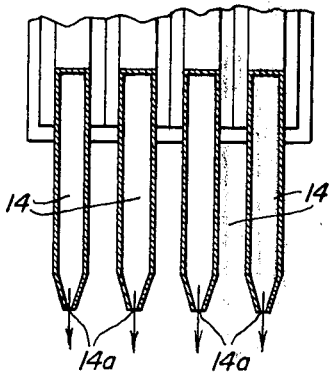

In the form of apparatus illustrated, a gas handling system provides for off-gas exhaust from a metal refining furnace 10. The system comprises an off-take conduit 11 having a vertical flue portion 11*a* and a horizontal flue portion 11*b* leading to a stack (not shown). A duct 12 for control air, delivered under pressure from a blower 13, has a main branch 12*a* leading to a set of nozzles 14 and a secondary branch 12*b* leading into flue portion 11*b* of conduit 11 beyond the nozzles.

Nozzles 14 have respective elongate discharge orifices 14*a* that, in this form of the invention, directly confront the cross-sectional area of conduit 11 taken across flue portion 11*a* thereof at a location downstream from abrupt turn portion 11*c* of the conduit. The individual nozzles extend entirely across the aforementioned cross-sectional area of the conduit in one dimension of such area, and are arranged in series, side-by-side, the series extending entirely across such area normal to the aforementioned one dimension thereof. As so arranged, control air delivered thereto under pressure from blower 13 is introduced into conduit 11 at a location such, and is directed such, that it comprehends substantially the entire cross-sectional area of the flue portion 11*a* of the conduit in opposition to normal gas flow therethrough. Moreover, this is accomplished without diminution of the cross-sectional flow area of the conduit or interference with fluid flow through the conduit.

Branch duct 12*b* is provided in the particular system illustrated for the purpose of supplying air for burning unconsumed hydrocarbons of the off-gases in portion 11*b* of fluid 11. It has no other function and need not be present. However, the illustrated arrangement is advantageous, since, up to a point, the higher the flow of off-gases, the more air required in the afterburner part of the flue 11*b*. Butterfly dampers 15 and 16 in branch ducts 12*a* and 12*b*, respectively, take care of this, since damper 16 is opened as damper 15 is closed and vice versa. Given functional capacity of blower 13 sufficient to send an air stream through main branch 12*a* of duct 12 and through nozzles 14 strong enough to completely prevent normal flow of gas through conduit 11, control throughout the range of no flow to full flow is provided by dampers 15 and 16. Operation of such dampers is preferably accomplished by remote manual control of a standard type of controller 17 by means of a pressure regulator (not shown) calibrated in terms of the position of damper 15 from full shut-off through the range to full open.

The illustrated system is usually operated at a normal flow rate of off-gases from furnace 10 through conduit 11 of 6994 standard cubic feet per minute (SCFM). Complete shut-off of flow is required in an emergency. When the furnace firing rate is reduced for any reason, it is desired to reduce the flow of off-gases to about 2547 SCFM by reducing the effective stack draft on the furnace. In accordance with the invention, this reduction of flow can be obtained by a flow of 968 SCFM of control air. However, reduction through the range of full flow to such reduced flow is not linear. Complete shut off is achieved with a flow of 2766 SCFM of control air.

It should be noted that the nozzles 14 are disposed substantially entirely outside the conduit through which normal gas flow is taking place, with the discharge orifices directed into the conduit from at least one side thereof, the direction of discharge being such as will comprehend substantially the entire cross-sectional area of the conduit in opposition to normal flow of gas therethrough, given a sufficient rate of control gas introduction.

Whereas this invention is here illustrated and described with particular a preferred specific embodiment thereof, it should be understood that various modifications of such embodiment and various other embodiments may be made without departing from the invention as particularly pointed out in the claims that follow.

We claim:

1. A method of controlling flow of gas through a conduit of a gas handling system, which conduit has an abrupt bend therein, comprising introducing a control gas into the conduit in direct opposition to the normal through-flow of gas into said bend and at a flow rate effective to accomplish the degree of control of said normal through-flow desired through a range of substantially no normal flow to substantially full normal flow, the introduction of control gas being in the form of a multiplicity of jet streams arranged in side-by-side adjacency and extending substantially entirely along one cross-sectional dimension of the conduit in a series which extends along the other cross-sectional dimension of the conduit substantially normal to said one cross-sectional dimension thereof, and said introduction of control gas being substantially without reduction of the cross-sectional area of said conduit or interference with gas flow through said conduit at said location at introduction when full normal flow is desired.

2. A method in accordance with claim 1, wherein the gas handling system is a gas discharge system associated with a material processing furnace for removing off-gases therefrom, and the control gas is atmospheric air.

3. A method according to claim 2, wherein atmospheric air is blown from a source of same toward the location of introduction of the control gas into the conduit; and wherein either all or part of said air is directed to and discharged into said conduit at said location, or either all or part of same is directed to and discharged into said conduit at a location beyond the first-named location.

4. In a gas handling system having a conduit for the flow of gas, which conduit has an abrupt bend therein, means for introducing a control gas into the conduit in opposition to the normal through-flow of gas in the conduit and at a flow rate effective to accomplish the degree of control of said normal through-flow desired through a range of substantially no normal flow to substantially full normal flow, said means comprising a source of control gas under pressure; a duct leading from said source to a location of gas introduction into said conduit; and nozzle means at said location for introducing control gas into said conduit from said duct, said nozzle means being disposed substantially entirely outside said conduit but with the discharge therefrom directed into said bend thereof in direct opposition to the normal flow of gas therethrough and made up of a series of individual nozzles arranged in side-by-side adjacency and having respective, elongate, discharge orifices that extend substantially entirely across the confronting cross-sectional area of the conduit in one dimension of said area, the same series extending substantially entirely across said area normal to said one dimension thereof.

5. A combination according to claim 4, wherein there is additionally included a second duct leading from the source of control gas under pressure to a second location of gas introduction into said conduit that is disposed beyond the first location; a valve for controlling flow of control gas through the first duct; and a valve for controlling flow of control air through the second duct.

* * * * *